United States Patent [19]

Brown

[11] Patent Number: 4,863,411

[45] Date of Patent: Sep. 5, 1989

[54] INFLATABLE TOY SIMULATING THE MOUTH OF AN INSECT

[76] Inventor: Alan W. Brown, 4 Hartley Cir., Apt. 824, Owings Mills, Md. 21117

[21] Appl. No.: 241,677

[22] Filed: Sep. 8, 1988

[51] Int. Cl.[4] ..... A63H 33/00; A63H 13/00; A63H 3/06

[52] U.S. Cl. ..... 446/27; 446/200; 446/226

[58] Field of Search ..... 446/26, 27, 28, 220, 446/221, 222, 223, 224, 225, 226, 180, 183, 184, 185, 197, 198, 199, 200, 201, 202

[56] References Cited

U.S. PATENT DOCUMENTS

| | | | |
|---|---|---|---|
| D. 561,114 | 8/1920 | Aronson | 446/416 |
| 1,214,028 | 1/1917 | Hainert, Jr. | 446/27 |
| 2,203,562 | 3/1938 | Edwards | 446/27 |
| 2,851,270 | 10/1955 | Ball | 446/188 |
| 3,346,989 | 10/1967 | Ryan et al. | 446/198 |
| 3,439,447 | 4/1968 | Green | 446/27 |
| 3,883,982 | 5/1975 | McClary | 446/416 |
| 4,447,250 | 5/1984 | Wolens et al. | 446/202 X |
| 4,583,957 | 4/1986 | Levy | 446/183 X |
| 4,759,737 | 6/1988 | Ferenczi | 446/198 X |

FOREIGN PATENT DOCUMENTS

| | | | |
|---|---|---|---|
| 1066927 | 10/1959 | Fed. Rep. of Germany | 446/202 |
| 1032217 | 6/1953 | France | 446/226 |
| 16641 | 11/1985 | United Kingdom | 446/27 |

*Primary Examiner*—Robert A. Hafer
*Assistant Examiner*—D. N. Muir
*Attorney, Agent, or Firm*—Diller, Ramik & Wight

[57] ABSTRACT

An inflatable toy simulating the mouth of an insect which includes a tubular mouthpiece, a sound-generating mechanism, a juncture between the mouthpiece and a pair of hollow arms, the arms being defined by first, medical and second terminal ends, the arms normally being folded with the second ends in end-to-end opposing relationship, and the material of the toy being so constructed as to maintain the arms in the latter position, and return the same from an inflated position at which the second ends of the arms project generally in opposite directions to each other with the overall effect thereof being that of the mouth of an insect.

4 Claims, 1 Drawing Sheet

INFLATABLE TOY SIMULATING THE MOUTH OF AN INSECT

BACKGROUND OF THE INVENTION

The invention is directed to an inflatable toy, in particularly an inflatable toy which simulates the mouth of an insect and can, for example, be utilized by youngsters on Halloween in association with typical Halloween costumes. More specifically, the simulated insect mouth of the present invention is adapted to be used with Applicant's novel GLASSES SIMULATING THE EYES AND ANTENNAE OF AN INSECT of Design application Ser. No. 07/242,261 filed on even date herewith. The simulated insect mouth is made of relatively flexible plastic material and includes a pair of tubular arms, each having first and second end portions joined to each other at a hinge portion with the second end portions normally opposing each other and being parallel to the first end portions in a first position thereof. The hollow arms are connected to each other at a hollow juncture portion which is part of a mouthpiece. The junction portion preferably, though not necessarily, includes a soundmaker or noisemaker. Appropriate depending appendages are disposed at a forward-facing portion of the juncture portion and the arms have a generally foliar configuration which collectively impart a generally insect mandiblelike appearance to the simulated insect mouth toy.

When a youngster holds the mouthpiece in his mouth, particularly while wearing the glasses noted earlier simulating the eyes and antennae of an insect, the youngster's appearance is quite foreboding. Furthermore, when the youngster then blows into the mouthpiece, the second end portions of the arms suddenly hinge about their hinge portions creating an "open" insect mouth position which, if such occurs suddenly and repetitively by rapid inhaling and exhaling, enhances the "bug" and foreboding appearance of the simulated insect mouth. Obviously, the noisemaker creates sounds which can be as foreboding as the appearance of the simulated insect mouth, and collectively the sight and sounds produce a highly effective facial mask, particularly in conjunction with the simulated eyes and antennae glasses heretofore noted.

SUMMARY OF THE INVENTION

The invention in its basic form is thus an inflatable toy which simulates the mouth of an insect and includes a pair of tubular hollow arms which are generally folded upon themselves in a first position but when air is blown into the arms, the same unfold into a second position; and when the latter is accomplished by repetitive inhalation and exhalation of the user, the appearance is that of the opening and closing of the mouth of an insect. Preferably the terminal end portions of the arms are provided with a generally foliar configuration and the juncture portion has insect mandible-like appendages to additionally impart an insect-like appearance to the toy.

Any type of conventional means may be provided for creating desired sound effects or noises as air is blown into and/or removed from the tubular arms through the mouthpiece by a user of the toy.

With the above and the other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
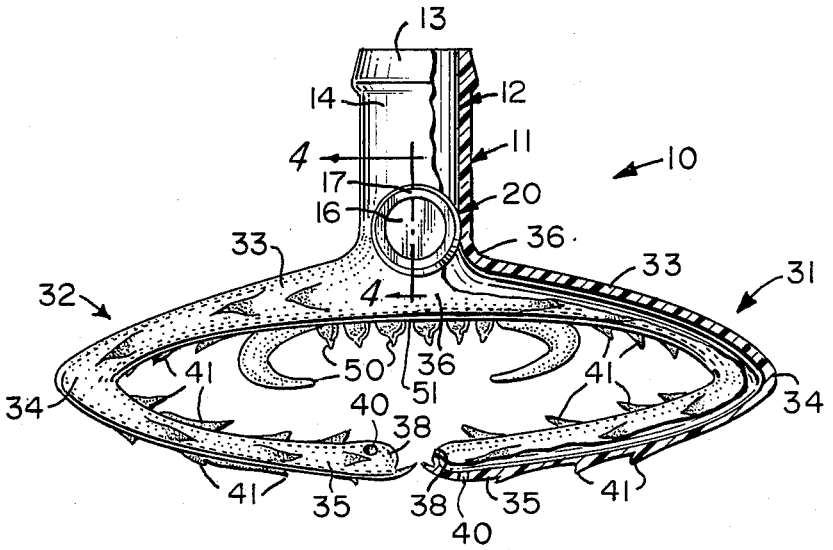
FIG. 1 is a top perspective view, partially broken away and shown in cross-section for clarity, of a toy simulating the mouth of an insect, and illustrates a tubular mouthpiece connected at a juncture portion to a pair of hollow arms of a foliar configuration shown folded about hinge portions thereof in a first closed position.
Figure 2:
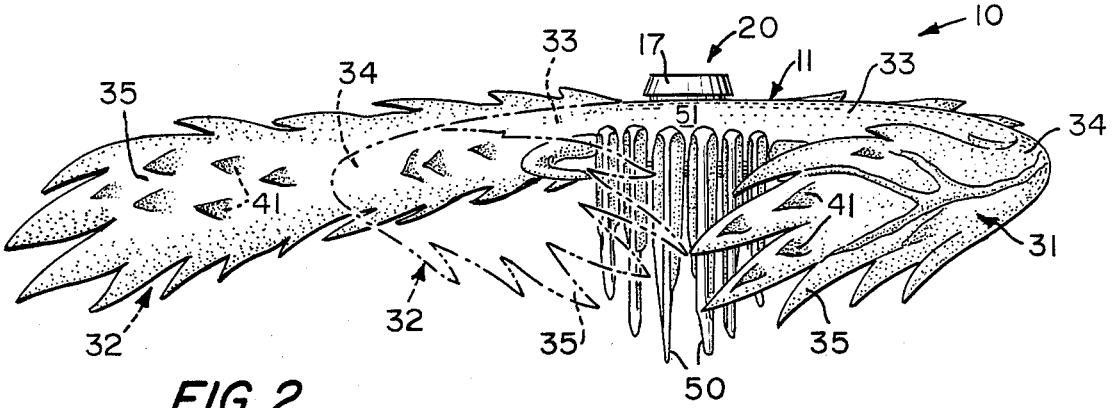
FIG. 2 is a front elevational view of the toy of FIG. 1, and illustrates in solid lines the folded first position of the right-hand arm, and in phantom outline the corresponding folded and unfolded positions of the left-hand arm.
Figure 3:
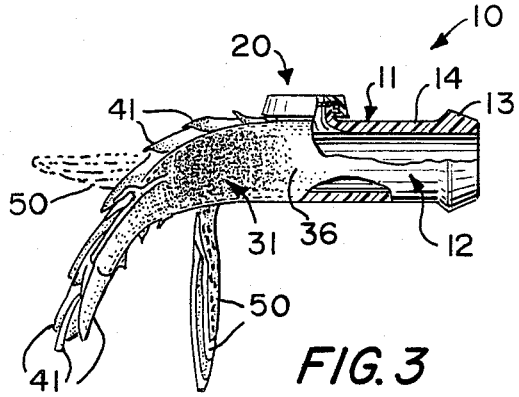
FIG. 3 is a side elevational view looking from right-to-left in FIG. 2 with a portion thereof broken away and shown in cross-section for clarity, and illustrates both arms in their folded first position and a plurality of depending appendages collectively imparting with the foliar arms a generally insect mandible-like appearance to the toy.

A novel inflatable toy simulating the mouth of an insect is illustrated in FIGS. 1 through 3 of the drawing, and is generally designated by the reference numeral 10.

The inflatable toy 10 includes body 11 constructed from polymeric or copolymeric synthetic plastic material, such as nylon or polytheylene. The body 11 is substantially hollow throughout and includes a hollow tubular mouthpiece 12 having a peripheral ridge 13 is a diameter slightly larger than the exterior diameter of a stem 14. When the mouthpiece 12 is placed in the mouth of a user, the user places his teeth against the stem 14 and the ridge 13 prevents the toy 10 from being expelled from the user's mouth when the user blows air into the mouthpiece 12 to generate sounds or noises by conventional sound-producing means 20 and simultaneously unfolding a pair of arms 31, 32 from the normal folded or closed position (FIG. 1) to the open position (left-most illustration of FIG. 2).

Figure 4:
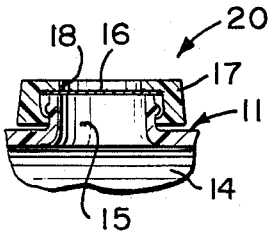
FIG. 4 is an enlarged cross-sectional view taken generally along line 4—4 of FIG. 1, and illustrates a sound-generating mechanism of the toy.

The sound-producing means 20 is a conventional kazoo consisting of an annular circular collar 15 (FIG. 4) rising upwardly from the stem 14 and defining an opening (unnumbered) which is covered by a membrane 16, such as a piece of paper. The membrane 16 is held clamped over the collar 15 by a conventional removable snap-can 17 having a circular aperture 18 therein. As air is blown into or sucked from the arms 31, 32 from the mouthpiece 12, this air vibrates the membrane 16 to emanate sounds therefrom. Preferably the material from which the membrane 16 is constructed, its thickness and other characteristics are such as to give a bug-like or insect buzzing quality to the sounds emanating therefrom or to tones hummed into, out of or through the stem 11 by the user inhaling through the mouthpiece 12.

The arms 31, 32 are identical and each includes a hollow first end portion 33, a terminal generally closed hollow end portion 35 and a medial hollow hinge portion 34. The first portions 33 merge with the stem 14 at a hollow juncture portion 36. As is most evident from the arm 31 of FIG. 1, the entirety of the arm 31, as well as the arm 32, is hollow from the juncture portion 36 to a terminal end 38. Each terminal end is preferably closed, although one or more relatively small pin-hole openings 40 can be provided therein to allow the limited escape of air therethrough when air is blown into the mouthpiece 12.

The overall surface configuration of the arms 31, 32 is provided with a plurality of relatively small appendages or projections 41 which impart a generally foliar configuration thereto. Furthermore, the second end portions 35 of each of the arms 32, 33, as viewed from the front (FIG. 2), are relatively wide or broad and narrow progressively toward the medial hinge portions 34. The generally fan-like configuration of the second end portions 35 thus partially overly and hide a plurality of spaced, adjacent depending appendages 50 at a fowardmost face or surface 51 of the juncture portion 14. The depending appendages 50 are illustrated as being solid, but each can also be tubular, just as the arms 31, 32 and if made hollow, each appendage 50 is in fluid communication with the juncture portion 14. The depending appendages 50 impart a generally insect mandible-like appearance to the juncture portion 14, and particularly the front face or surface 51 thereof in conjunction with, of course, the foliar second end portions 35 of the arms 31, 32.

The polymeric or copolymeric material of the body 11 is selected such that the arms 31, 32 will normally be in the position shown in FIG. 1, namely, the non-pressurized first position thereof in which the second end portions 35 are generally in adjacent end-to-end opposing relationship to each other. This same position is represented in FIG. 2 by the solid line illustration of the arm 31 and the folded phantom outline illustration of the arm 32. The latter illustrations of the arms 31, 32 readily characterize the insect mouth simulated by the appendages 50, the arms 31, 32, and particularly the second end portions 35 thereof due to the foliar configuration imparted thereto by the projections 41. Accordingly, with the arms 31, 32 closed, the appearance of the toy from the front (FIG. 2) is an excellent simulation of the mouth of an insect, particularly its mandible-like appearance, and imparts to the viewer, particularly if young, a threatening, ominous or portentous character. The latter is emphasized when the toy 10 is utilized in conjunction with the insect eyes and antennae glasses earlier noted herein. Furthermore, the foreboding nature of the toy 10 is increased and rendered life-like when the user places the mouthpiece 12 in his mouth and blows through the stem 11. Air passing the membrane 16 creates/generates an appropriate buzzing/insect sound, and the same air pressurizes the interior of the arms 31, 32 causing the same to hinge about the hollow hinge portions 34 until both arms "open" to their second fully-open position, as illustrated by the left-most illustration of the arm 32 in FIG. 1. Both arms 31, 32 open simultaneously, of course, and when this is done rapidly, the appendages 50 are fully exposed. When the unfolding just described is done rapidly by a quick "blast" of air blown into the mouthpiece 12, the suddenness of the movement of the arms 31, 32 from the closed (FIG. 1) to the open (left-most illustration of FIG. 2) positions is alarming, particularly in conjunction with the sound emanating from the sound-producing means 20. The appearance is that of an insect opening its mouth, and when the air is released and the arms 31, 32 depressurize, the inherent resiliency of the plastic material of the body 11 brings the arms 31, 32 back to the closed position (FIG. 1).

Should the user rapidly alternately inhale and exhale through the mouthpiece 12, the arms 31, 32 rapidly open and close while the sound created by the membrane 16 varies in frequency, peak and attenuation. This rapid opening and closing of the arms 31, 32 imparts a "chewing" characteristic to the simulated insect mouth, and the frequency variation of the sound emitted from the sound-generating means 20 adds to the overall simulation. Furthermore, if the depending appendages 50 are tubular, they will expand and contract during respectively exhalation and inhalation causing an "undulating" appearance at the front face (FIG. 2) or surface 51. Alternatively, rather than merely expanding and contracting, the hollow depending appendages 50 can be so constructed that while they normally depend downwardly from the juncture 14, as in FIG. 3, when inflated, they will hinge outwardly and forwardly of the face 51 as the second end portions 35 of the arms 31, 32 unfold, as shown in phantom outline in FIG. 3. Hence, as the second end portions 35 unfold and return, the appendages move out forwardly and toward the horizontal and subsequently return, respectively. The latter movements further exaggerate the insect-like appearance of the toy when viewed from the front (FIG. 2).

The pin hole openings 40 permit air to be blow through the arms 31, 32 while they are in their fully open position. The purpose here is to allow air to vibrate the membrane 16 to generate sound while the arms 31, 32 are held open. However, as noted earlier herein, the pin hole openings 40 are not necessary and the toy 10 is fully operative absent the same as heretofore described.

While a preferred embodiment of the toy 10 has been described herein, it is to be understood that variations may be made in the construction thereof without departing from the present invention. For example, though the arms 31, 32 have been described as being entirely hollow or hollow along the entire lengths thereof, each arm need but be hollow along the portions 33, 34 to permit the opening and closing motion heretofore described and, therefore, each end portion 35 can be solid. In this construction the arms 31, 32 would still bend or hinge at the hollow hinge portions 34 between the opened and closed positions shown in FIG. 2, through the end portions 35 are solid.

The sound-producing means 20 also need not necessarily be located in the area of the stem 14 but can be located anywhere between the opening (unnumbered) adjacent the ridge 13 of the mouthpiece 12 and the terminal end portions 38, 38 of either or both of the arms 31, 32. Furthermore, the sound-producing means 20 need not be a kazoo, but any conventional sound-producing mechanism would suffice.

Furthermore, though a plurality of appendages 50 (FIGS. 1 and 2) are illustrated in the drawings, a single wider and/or longer appendage can be provided, including one that would tend to inherently roll-up automatically as air is exhaled therefrom. In other words, such a single or multiple appendage would normally be rolled upon itself, when air is blown therein it/they would unroll, and upon the inhalation of air or simply the exhausting of air therefrom, the one or more appendages would automatically reroll toward the surface 51.

Although a preferred embodiment of the invention has been specifically illustrated and described herein, it is to be understood that minor variations may be made in the apparatus without departing from the spirit and scope of the invention, as defined in the appended claims.

I claim:

1. An inflatable toy simulating insect mouth parts comprising a pair of generally tubular arms, each arm having first end and second end portions and a medial hinge portion between said first and second end portions, said first and second end portions and medial hinge portion each being generally hollow, said second end portions each having a terminal end which is generally closed, said arms being constructed from generally flexible material and being adapted for movement of said second end portions about the associated hinge portions upon internal pressurization of said arms from a first position at which said second end portions are in generally adjacent end-to-end opposing relationship to each other with said terminal ends adjacent each other and in side-by-side relationship to the associated first end portions and a second position at which said second end portions project in generally opposite directions with said terminal ends in maximum remote spaced relationship from each other, means for a user to introduce pressurized air into said first end portions to cause said relative movement about said associated hinge portions, said first position is the nonpressurized condition of said arms, said toy being constructed from polymeric or copolymeric plastic material which inherently maintains said second arm portions in said first position in the absence of sufficient pressurized air to move the arms to said second position, at least said second end portions have a plurality of adjacent projections imparting a generally foliar configuration thereto, a hollow juncture portion at which said first end portions are joined to each other, said air-introducing means includes a mouthpiece adjacent said juncture portion, and a plurality of spaced adjacent depending appendages at said juncture portion, the combination imparting a generally insect mandible-like appearance to said inflatable toy.

2. The inflatable toy as defined in claim 1 wherein said second end portions generally at least partially overlap said depending appendages when in said first position.

3. The inflatable toy as defined in claim 1 wherein said depending appendages are generally hollow whereby said appendages indulate upon the introduction of pressurized air therein.

4. The inflatable toy as defined in claim 2 wherein said depending appendages are generally hollow, whereby said appendages indulate upon the introduction of pressurized air therein.

* * * * *